United States Patent [19]

Focke et al.

[11] Patent Number: 4,840,321

[45] Date of Patent: Jun. 20, 1989

[54] APPARATUS FOR FEEDING PACKAGING-MATERIAL REELS TO A PACKAGING MACHINE

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 95,594

[22] Filed: Sep. 11, 1987

[30] Foreign Application Priority Data

Sep. 13, 1986 [DE] Fed. Rep. of Germany ..... 3631205

[51] Int. Cl.[4] ..... B65H 19/12; B65H 16/04

[52] U.S. Cl. ..... 242/58.6; 242/68.3; 242/81

[58] Field of Search ..... 242/58, 58.6, 72 B, 242/79, 81, 68.3

[56] References Cited

U.S. PATENT DOCUMENTS

| | | | |
|---|---|---|---|
| 3,478,974 | 11/1969 | Roscoe et al. | 242/58 |
| 3,690,583 | 9/1972 | Herman | 242/81 X |
| 3,718,302 | 2/1973 | Mount et al. | 242/81 |
| 3,847,366 | 11/1974 | Schmidt et al. | 242/81 X |
| 4,366,932 | 1/1983 | Focke | 242/58.6 |
| 4,575,018 | 3/1986 | Ichikawa | 242/58 X |

FOREIGN PATENT DOCUMENTS

| | | |
|---|---|---|
| 0041743 | 9/1980 | European Pat. Off. . |
| 0155863 | 9/1985 | European Pat. Off. . |
| 839187 | 5/1952 | Fed. Rep. of Germany . |
| 1108239 | 7/1965 | Fed. Rep. of Germany . |
| 2037623 | 2/1972 | Fed. Rep. of Germany . |
| 2558964 | 11/1976 | Fed. Rep. of Germany . |
| 3342080 | 5/1985 | Fed. Rep. of Germany . |
| 3342204 | 5/1985 | Fed. Rep. of Germany . |
| 3501813 | 7/1985 | Fed. Rep. of Germany . |
| 1587426 | 3/1970 | France . |
| 2035966 | 6/1980 | United Kingdom . |
| 2167047 | 5/1986 | United Kingdom . |

*Primary Examiner*—John M. Jillions

*Attorney, Agent, or Firm*—Sughrue, Mion, Zinn, Macpeak & Seas

[57] ABSTRACT

To transfer reels (11) to supporting journals (15, 16) of a reel-changing device (12) of a packaging machine (10), the supporting journal (15) is axially displaceable. As a result, the reel can be delivered in the working plane or run-off plane without any transverse displacement and held in the receiving position, while the supporting journal (15, 16) penetrates into a central orifice (42) in the reel (11) as a result of axial displacement.

19 Claims, 5 Drawing Sheets

APPARATUS FOR FEEDING PACKAGING-MATERIAL REELS TO A PACKAGING MACHINE

DESCRIPTION

Figure 1:
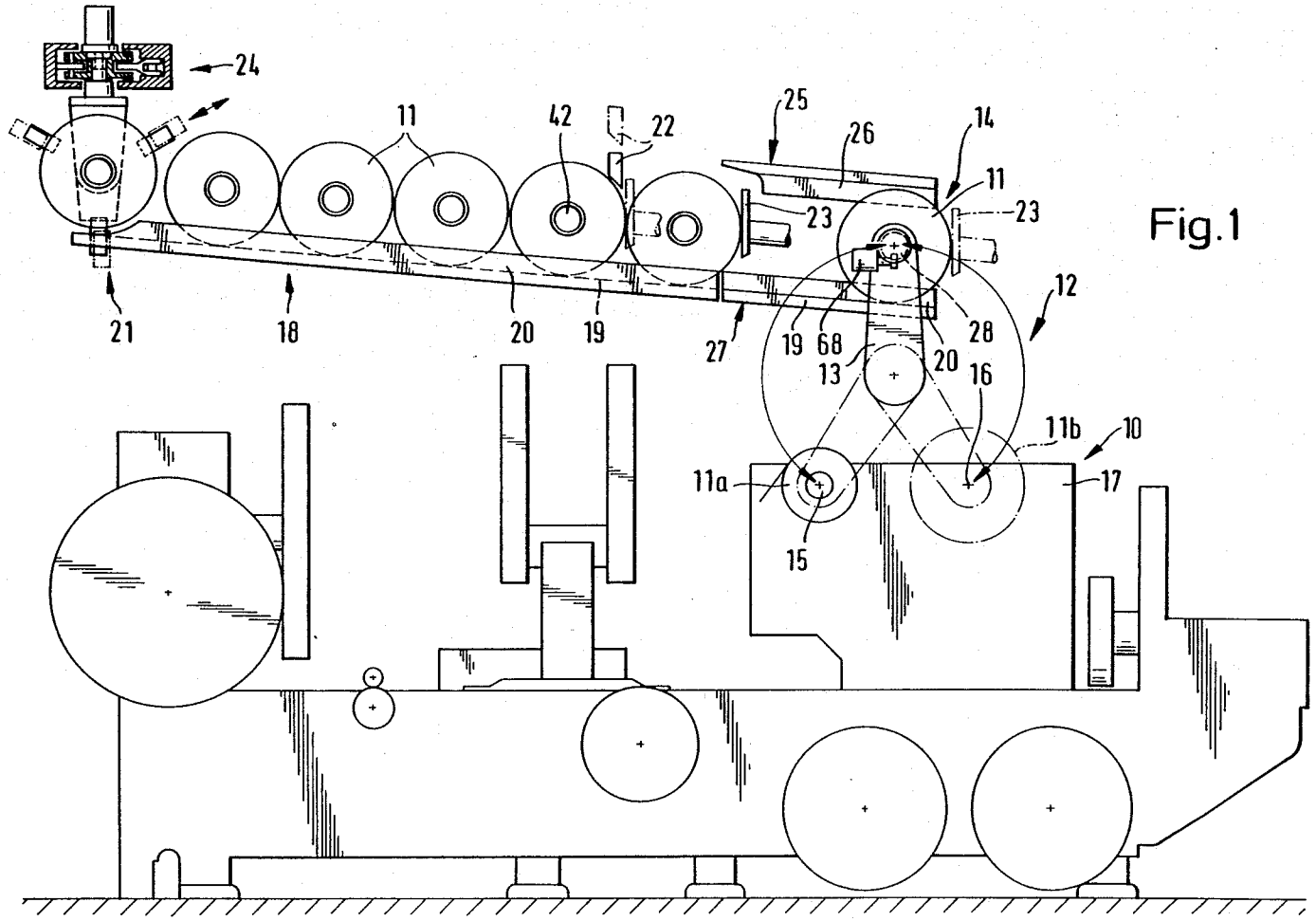

The invention relates to an apparatus for feeding reels of packaging material to a reel-changing device of a packaging machine, the reel-changing device having at least one supporting journal which projects form a holder (reel supporting frame) and which penetrates into a central orifice in the reel for the mounting of the latter.

High-performance packing machines have to be fed with packaging material in sufficient quantities. On cigarette-packaging machines, tin foil as an inner wrapping for the cigarettes, paper (for soft-cup packs) and transparent foil or platic film must be provided. This material is conventionally attached to the packaging machine in the form of wound roll (reel) and is drawn off in proportion to the consumption of packaging material. For this purpose, the reels are received by rotating supporting journals which are mounted on one side and which penetrate into a central reel orifice formed by a cylindrical core (usually a carboard core).

The invention is concerned with the essentially automatic feeding of reels to a packaging machine and with the transfer of these to a reel-changing device equipped with supporting journals and located on the packaging machine.

The object on which the invention is based is to guarantee a reliable high-performance change-over or transfer of the reels without manual involvement.

To achieve this object, the apparatus according to the invention is characterized in that the supporting journals are mounted on the holder (reel supporting frame) so as to be axially displaceable and, to receive a reel, can be pushed out of a retracted initial position into the central orifice in the reel supplied in the working plane.

Reel-changing devices are convcentionally equipped with two supporting journals, one for each reel. One supporting journal receives a running-off reel, whilst the other supporting journal is intended for changing a run-off reel for a new one and supplying this. The supporting journals can be attached next to or above one another on a fixed or movable (rotatable) reel supporting frame.

According to the invention, the two supporting journals of the reel-changing device are axially displaceable, the new reel being fed in the working plane, that is to say in the plane of the running-off reel, and being attached onto the supporting journal as a result of the axial displacement of the latter. Accordingly, there is no need for any transverse shift of the reels during the feed. Furthermore, according to the invention, the core of the run-off empty reel is pushed off from the supporting journal automatically, when the latter is moved back into the initial position in the axial direction.

According to a further proposal of the invention, the reels are fed to the reel-changing device by means of a reel conveyor, especially by means of a pivotable reel-conveying arm, on the end of which is arranged a transversely projecting, likewise axially displaceable conveying journal for receiving the reel during the transfer. The reel-conveying arm, together with a (new) reel, is moved in front of the standing-by supporting journal of the reel-changing device, in such a way that the supporting journal and the conveying journal lie in the same axis, with their free end faces adjacent to one another. The supporting journal to be fed is now extended in the axial direction, whilst the conveying journal is retracted to the same extent. The reel is thereby transferred, without being moved. The supporting journals and conveying journals can be driveable in a suitable way in order to execute the axial movements. Preferably, the supporting journals of the reel-changing device are actuated by means of compressed air, whilst the conveying journal of the reel-conveying arm is adjusted mechanically or electromechanically by means of an electric motor via a gear-wheel mechanism.

The supporting journals of the reel-changing device have further special features. Thus, incorporated in each of the supporting journals is a tension brake which is actuated according to the tension detected in the running-off sheet, in order to ensure that the sheet is always conveyed at approximately the same tension.

Furthermore, in the region where the reel bears, the supporting journals are equipped with radially movable clamping members for the releaseable fixing of the reel. According to the invention, these are actuated pneumatically, specifically via the supporting journal or a piston rod assigned to this.

According to a further feature of the invention, apreconveyor is assigned to the reel conveyor (reel-conveying arm) and can receive a multiplicity of reels and thus serve as a reel store. The particular reel located at the front on the pre-conveyor is fixed in a take-over position, so that the conveying journal of the reel-conveying arm can penetrate into the central orifice in the reel as a result of the radial movement.

Futher features of the invention relate to the design of the reel-changing device and of the reel-conveying arm, together with the conveying journal, and to the preconveyor.

Figure 2:
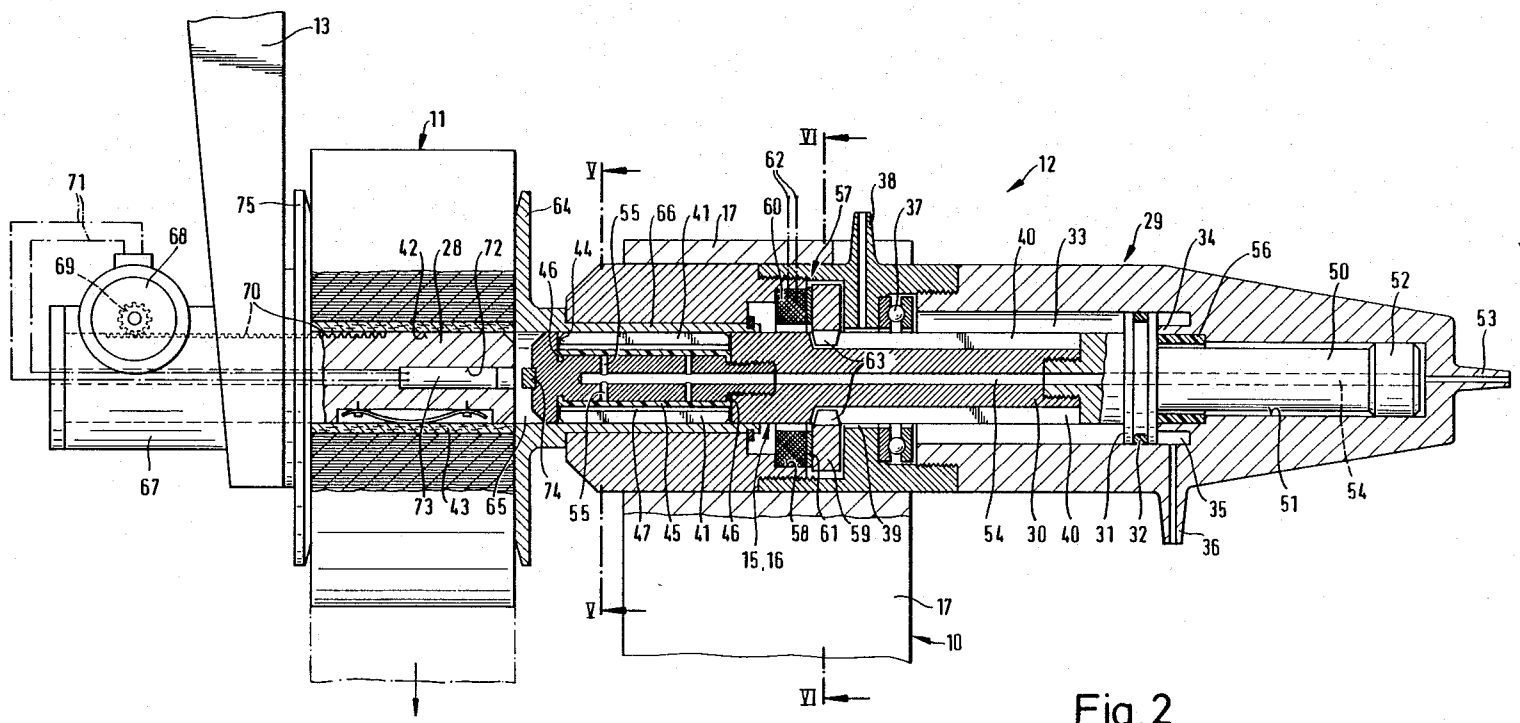
Figure 3:
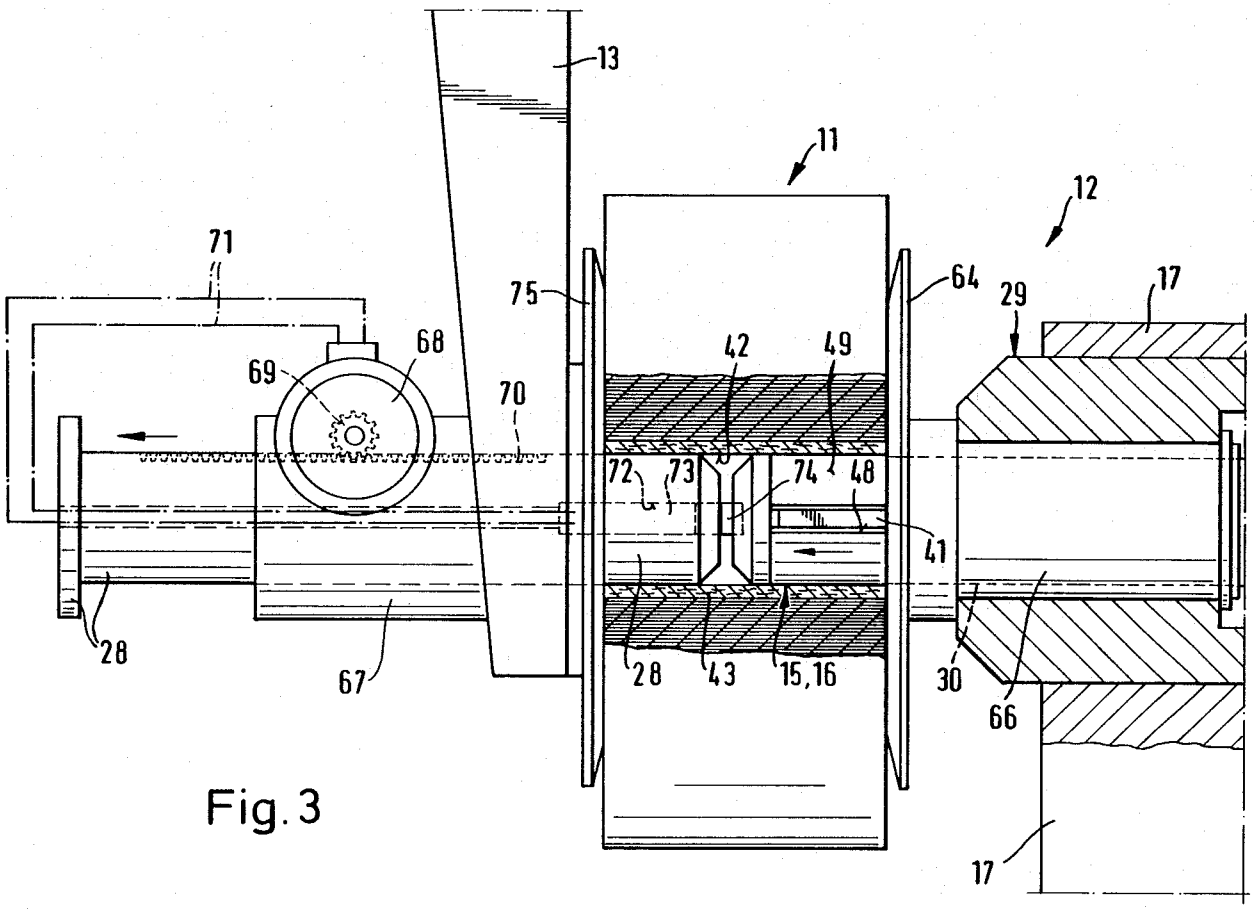
Figure 4:
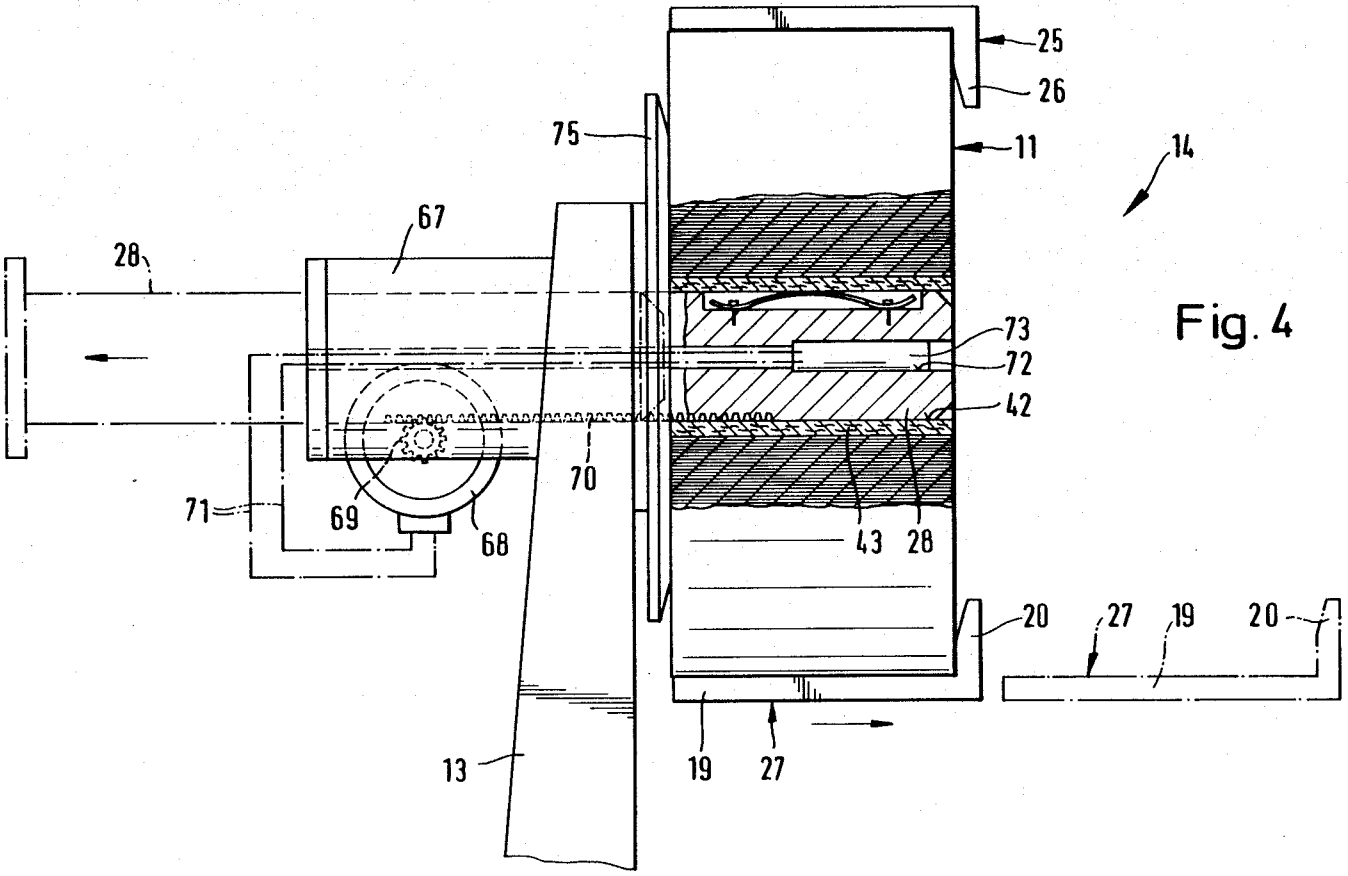
Figure 6:
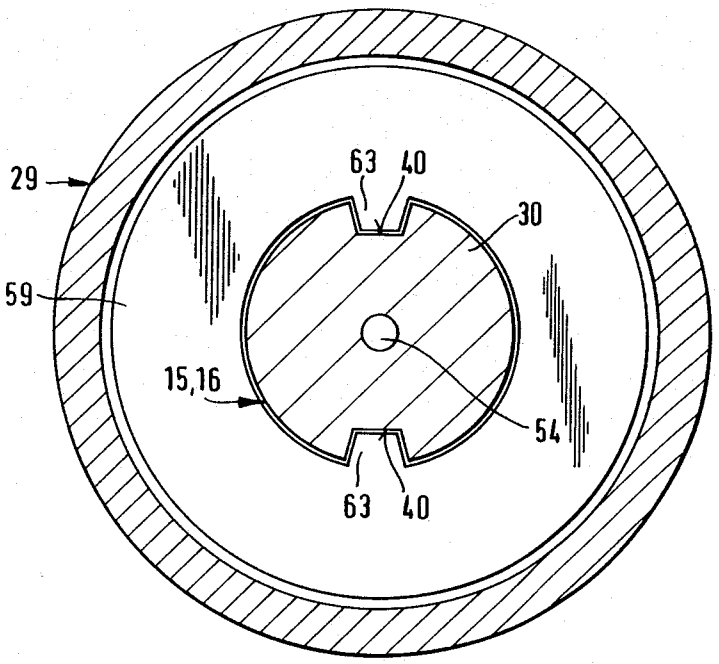
Figure 5:
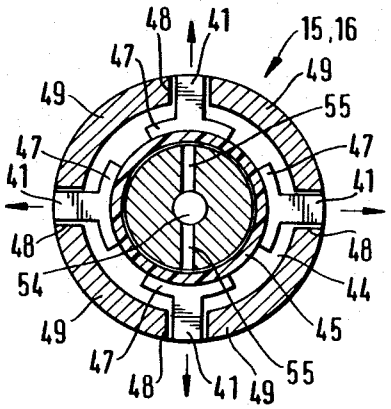

An axemplary embodimemt of the invention is explained in detail below with reference to the drawings. In these: FIG. 1 shows a diagrammatic side view of an upper region of a packaging machine with a reel-changing device, FIG. 2 shows a supporting journal and conveying journal in a side view and in longitudial section during the transfer of a reel, FIG. 3 shows, on an enlarged scale, a cut-out from the detail according to FIG. 2 during another phase in the transfer of a reel, FIG. 4 shows the take-over of a reel by a reel-conveying arm in a side view and in axial section, FIG. 5 shows a cross-section through the supporting journal of the reel-changing device in the plane V—V of FIG. 2, FIG. 6 shows a cross-section in the plane VI—VI of FIG. 2.

FIG. 1 shows diagrammatically a side view of a packaging machine 10 for cigarettes, especially for producing hinge-lid packs. For these packs, packaging material is consumed continuously in relatively large quantities. This is also true particularly of an inner wrapping of tin foil for the cigarettes. This packaging material is delivered to the packaging machine 10 in the form of rolls or reels 11 and is then processed into individual blanks.

For feeding the reels 11, the packaging machine 10 has a reel-changing device 12 assigned to it. In the present case, this consists of a fixedly mounted pivotable conveying arm 13 which receives individual reels 11 from a transfer station 14 and which delivers each of them to one of two supporting journal 15, 16 located on the machine. These are mounted on a reel supporting frame 17 of the packaging machine 10 so as to project on one side and be rotatable. On of the supporting journals (here, the supporting journal 45) carries the running-off "active" reel 11*a*, whilst the other supporting journal 16 is ready to feed a new fresh reel 11*b*.

The transfer station 14 is part of a feed conveyor 18 which, here, is arranged above the packaging machine 10 and which is designed as a rolling track for the reels 11 which descends obliquely downwards in the direction of the transfer station 14. The reels 11 are placed on the feed conveyor 18 in a vertical position (in a vertical plane) and as a result of the gradient move automatically towards the lower transfer station 14 at the rate of further conveyance.

The feed conveyor 18 consists of a lower supporting section of angular cross-section, with a horizontal or obliquely downward-directed supporting leg 19 and a lateral vertical guide leg 20. In the region of a loading station 21, the reels 11 are placed on the upper end of the feed conveyor 18 and in the lower region are held in front of the transfer station 14 by a stop 22 movable up and down. The particular reel at the bottom or at the front, running off on the supporting leg 19, is fed to the transfer station 14 and is fixed here exactly in position by means of a limit stop 23 movable in the direction of movement of the reels 11. The stop 22, by moving upwards and then moving downwards into the stopping position, releases only one reel for movement into the transfer station 14 at any one time.

The reels 11 are delivered to the feed conveyor 18 by means of a main conveyor 24 which is designed here as a circular conveyor rotating inside the packaging room.

In the region of the transfer station 14, the reels 11 are each fixed additionally, specifically by means of an upper guide 25 which is likewise angular in cross-section, with a lateral bracing leg 26. The reel, when taken over by the conveying arm 13, comes up against the guide leg 20 of the feed conveyor 18 and the bracing leg 26 of the upper guide 25 with a supporting effect. After the reel 11 has been taken over by the conveying arm 13, the latter is pivoted in the clockwise direction or in the anti-clockwise direction towards one or other of the supporting journals 15, 16. If there is movement in the anti-clockwise direction, after the reel 11 has been received by the conveying arm 13 an end piece 27 of the feed conveyor 18 is moved to the side (as represented by dot-and-dash lines in FIG. 4). The conveying arm 13 can now be moved freely, together with the reel, in the anti-clockwise direction.

To receive a reel 11 for transport, the conveying arm 13 is equipped with a conveying journal 28 projecting transversely on one side. This, like the supporting journals 15, 16, penetrates into the central orifice 42 in the reel 11 from one side and carries the latter. For receiving and transferring reels, the suporting journals 15, 16 and the conveying journal 28 are axially displaceable.

FIG. 2 shows, in axial section, a supporting journal 15, 16, together with the conveying journal 28, during the transfer of a reel 11. The supporting journal 15, 16 is mounted in an elongate, preferably cylindrical housing 29. This is connected fixedly to the reel supporting frame 17 of the packaging machine 10. The supporting journal 15, 16 is axially displaceable in the housing 29. FIG. 2 shows the retracted initial position. Within the housing 19, a piston rod 30 is adjacent to the actual supporting journal 15, 16 receiving the reel 11 and, in the extended position, projecting from the housing 29. This piston rod 30, in turn, has a widening of its cross-section in the form of an encircling collar 31 in the end region remote from the supporting journal 15. 16. This collar 31 forms a piston which, equipped all-round with a gasket 32, is displaceable in a cylinder chamber 33 of annular cross-section in the housing 29.

In the initial position shown, the collar 31 rests against the shoulder 34 of the housing 29, formed as a result of a narrowing of the cross-section in this region. Pressure medium is supplied via an annular channel 35 which is formed in the housing 29 and which is fed with compressed air via a line extension 36.

To shift the supporting journal 15, 16 axially into the working position, the collar 31 is displaced by means of compressed air until it comes up against an abutment located at the end of the cylinder chamber 33, in the present case this being formed by an axial ball bearing 37. The collar 31 is braced against this axial ball bearing 37 and thus allows the supporting journal 15, 16, including the piston rod 30, to rotate, in order to draw off the sheet from the reel 11 as a result of the rotating of the latter.

For the return movement of the collar 31 and consequently of the supporting journal 15, 16 into the initial position shown, a further line extension 38 for compressed air is attached next to the axial ball bearing 37. The compressed air supplied here can take effect in the way described via an annular gap 39 and via longitudinal grooves 40 in the piston rod 30.

The supporting journal 15, 16 is equipped with holding members which, when the supporting journal 15, 16 is in the extended position, take effect in the radial direction and fix the reel 11 on the supporting journal 15, 16. In the exemplary embodiment illustrated, in the bearing region of the reel 11 there are (four) clamping jaws 41 which are arranged distributed in the peripheral direction and which come to rest against the inside of a central orifice 42 in the reel as a result of radial displacement. The reels 11 are conventionally equipped with a cylindrical core, in particular a core tube 43, against which the clamping jaws 41 rest for the retention of the reel 11.

The clamping jaws 41 are actuated pneumatically. For this purpose, the clamping jaws 41 are mounted in a lathe-turned clearance or encircling recess 44 of the supporting journal 15, 16. As is especially evident from FIG. 5, the clamping jaws 41 are supported on a sleeve 45 made of elastic material, for example rubber. The sleeve 45 surrounds the supporting journal 15, 16 in the region of this reduction in cross-section. The sleeve sealed off at its ends by means of inward-directed sealing legs 46 can be subjected to compressed air from inside and can thus be expanded, at the same time with a radial increase in cross-section. This radial increase in cross-section of the sleeve 45 on all sides results in a corresponding radial movement of the clamping jaws 41 up against the reel 11. The clamping jaws 41 are made T-shaped in cross-section, with inner curved supporting flanges 47 which rest against the sleeve 45. The web-like clamping jaws 41 pass through slits 48 in the casing 49 of the supporting journal 15, 16.

The above-described holding device is supplied with compressed air via the piston rod 30. This is continued in the form of a compressed-air chamber 51 by means of a piston extension 50. The compressed-air chamber 51 is formed adjacent to the the cylinder chamber 33 in a corresponding extension of the housing 29. At the free end, the piston extension 50 is equipped with a cylindrical thickened piston 52.

Compressed air is supplied to the compressed-air chamber 51 via a line connection 53 in an end wall of the housing 29. The compressed air passes via an axial channel 54 in the piston extension 50 and in the piston rod 30 into the region of the sleeve 45. Formed here on the axial channel 54 are transversely directed distributor ducts 55 which open out on the inside of the sleeve 45 and which cause the above-described expansion of the latter by means of compressed air. The compressed air is transferred to the sleeve 45 in the region of gaskets 56 in the compressed-air chamber 51 in one position of the thickened piston portion 52.

Incorporated in the unit consisting of the supporting journal 15, 16 and housing 29 is a tension brake 57 which serves for maintaining a specific predetermined tension in the sheet running off from the reel 11. Here, the tension brake 57 is electromagnetic. A brake ring 59 is mounted in an angular recess 58 of the housing 29 so as to be axially displaceable. When current is supplied to the tension brake 57 this brake ring 59 is pulled up against a counter-ring 30, annular brake surfaces 61 coming to rest on one another and thus being activated. The counter-ring 60 is equipped with an electrical winding which is fed via lines 62.

The tension brake 57 is controlled by the sheet itself, in particular according to the tension measured in this. For this purpose, the sheet is guided over rockers or compensating rollers of known design. Variations in the position of the deflecting members causes the tension brake 57 to be actuated in the tightening or relaxing direction.

The brake ring 59 is connected positively to the piston rod 30 as a prevention against rotation. Radially inward-directed retaining teeth 63 penetrate on sides located opposite one another into the above-mentioned longitudinal grooves 40 of the piston rod 30 and allow the relative displacement of the latter when the supporting journal 15, 16 is retracted and extended.

When a reel 11 is transferred to the reel-changing device 12 of the packaging machine 10, the axial movements of the supporting journal 15, 16, on the one hand, and of the conveying journal 28 of the conveying arm 13, on the other hand, are co-ordinated with one another. The reel 11 is conveyed in the exact position in front of the retracted supporting journal 15, 16 by the conveying arm 13, specifically without any axial displacement of the reel 11. This comes to rest against a plate-like lateral guide 64 assigned to the reel journal 15, 16. This lateral guide 64 is provided with a central orifice 65 for the matching passage of the supporting journal 15, 16. The lateral guide is mounted rotatably on or in the housing 29, in the present case by means of a hollow cylindrical axle piece 66 which is mounted in the corresponding recess of the housing 29 so as to be rotatable, but non-displaceable axially, specifically surrounding the supporting journal 15, 16 in the retracted position.

After a reel 11 has been advanced to the supporting journal 15, 16 (FIG. 2), the axial displacement of the supporting journal 15, 16 and correspondingly the retracting movement of the conveying journal 28 begins. In the present exemplary embodiment, the latter is driven electromechanically. At the same time, the conveying journal 28 is guided in a hollow cylindrical piece 67 attached to the conveying arm 13. Attached to this hollow cylindrical piece 67 is a drive motor, in particular a servo-motor 68. This is connected in drive terms, via a pinion 69, to a toothed groove 70 made in the rear part of the conveying journal 28.

The servo-motor 68 is actuated by means of the (extending) supporting journal 15, 16. For this purpose, the servo-motor 68 is connected, via control lines 71 running in the axis of the conveying journal 28, to an actuating member arranged in an axial bore 72, in particular an electrical initiator 73. This switching member of known design and mode of operation is subjected to stress by a metal piece 74 on the end face of the supporting journal 15, 16, when the latter is shifted in the axial direction. The servo-motor 68 is now switched on and, in turn, moves a conveying journal 28 into the retracted position (to the Left as regards FIGS. 2, 3, and 4). The movements of the members are co-ordinated with one another, in such a way that the conveying journal 28 determines the axial movement of the supporting journal 15, 16 too, since they come up against one another because the supporting journal 15, 16 is appropriately subjected to compressed air.

During the penetration of the supporting journal into the central orifice 42, the reel 11 does not experience any transverse shift, but is held without movement between the lateral guide 64 of the supporting journal 15, 16 and a likewise plate-like counter-guide 75 on the conveying arm 13.

The take-over of the reels 11 in the region of the transfer station 14 takes place in a similar way. When the conveying journal 28 is retracted, the conveying arm 13 is moved up to the side of the reel 11 facing it, the plate-like counter-guide 75 resting against the side of the reel 11 facing it. The conveying journal 28 is now extended into the position shown in FIG. 4 as a result of the actuation of the servo-motor 68. At the same time, the feel 11 is supported on the legs 20 and 26.

The particular supporting journal 15, 16 is retracted into the initial position in the region of the reel-changing device 12, when the respective reel 11 has run empty. During this retracting movement, the core tube 43 is automatically stripped off from the supporting journal 15, 16 at the same time, specifically because the latter comes up against the lateral guide 64, the orifice 65 of which is smaller than the outside diameter of the core tube 43.

We claims

1. Apparatus for transferring and feeding reels of packaging material to a reel-changing device of a packaging machine, the real-changing device having at least one supporting journal which projects from a reel supporting frame and which penetrates into a central orifice in the reel for the mounting of the latter; said apparatus comprising:

means for mounting said supporting journal (15, 16) on said reel supporting frame (17), so as to be axially displaceable, and for pushing said journal (15, 16) from a retracted initial position into an extended position in a central orifice (42) in the reel (11) to receive the reel supplied in a working plane;

a pivotably mounted conveying arm (13) for feeding the reels (11) of the reel-changing device (12); and a transversely projecting reel conveying journal (28) which is arranged on said conveying arm (13) and which is axially displaceable in order to receive a reel in a transfer station (14) and to deliver the reel to the reel-changing device (12).

2. Apparatus according to claim 1, characterized in that new full reels (11) are fed to the reel-changing device (12) or to the reel supporting journals (15, 16) of the latter in the working plane from above or from the side.

3. Apparatus according to claim 1 or 2, characterized in that a core tube (43) of an emptied reel is stripped off from the reel supporting journal (15, 16) as a result of the retraction of the latter into the initial position.

4. Apparatus according to claim 1, characterized in that the reel-changing device (12) has at least two reel supporting journals which are supplied alternately with reels (11), each supporting journal (15, 16) being axially displaceable independently.

5. Apparatus according to claim 1, further comprising means for moving, during the transfer of a reel to the reel-changing device (12), the conveying journal (28) of the conveying arm (13), when arranged in the same axis as a supporting journal (15, 16), out of the central orifice (42) in the reel (11) to the same extent as the supporting journal (15, 16) of the reel-changing device (12) is pushed into said central orifice (42).

6. Apparatus according to claim 1, characterized in that the reel supporting journal (15, 16) of the reel-changing device (12) is movable to and fro in the axial direction by means of pressure-medium cylinders.

7. Apparatus according to claim 1, further comprising servo-motor means (68) for electromotively driving the supporting journal (15, 16) of the reel-changing device (12) and the conveying journal (28) of the conveying arm (13) in order to execute axial displacements, said servo-motor means (68) being engaged, via a pinion (69), with a toothed groove (70) of the conveying journal (28).

8. Apparatus according to claim 5, characterized in that the speed of the extending movement of the reel supporting journal (15, 16) is controlled by means of the retracting movement of the conveying journal (28), the supporting journal (15, 16) resting with its free end against the end of the conveying journal (28) facing it.

9. Apparatus according to claim 7, characterized in that the drive of the conveying journal (28) is effected by means of a supporting journal (15, 16) at the start of the extending movement, said drive being effected via an initiator (73) which is arranged in the conveying journal (28) and which is subjected to stress by the supporting journal (15, 16).

10. Apparatus according to claim 1, further comprising bearing members for the reel (11) which are assigned respectively to the supporting journal (15, 16) of the reel-changing device (12) and to the conveying journal (28) of the conveying arm (13); said bearing members respectively comprising a plate-like lateral guide (64) and counterguide (75), each of which is provided with a central orifice (65) which corresponds to the outside diameter of the supporting journal (15, 16) and of the conveying journal (28) respectively.

11. Apparatus according to claim 1, characterized in that the reel supporting journal (15, 16) is mounted so as to be axially displaceable and rotatable in an elongate housing (29) which is connected fixedly to a reel supporting frame (17).

12. Apparatus according to claim 11, characterized in that within the housing (29) is formed an annular cylinder chamber (33), in which a piston rod (30) connected to the supporting journal (15, 16) and having a cylindrical collar (31) is subjected to pressure medium and shifted axially.

13. Apparatus according to claim 12, characterized in that, in the retracted initial position, the collar (31) rests against a shoulder (34) formed as a result of a narrowing of the cross-section of the cylinder chamber (33), and in the extended position of the supporting journal (15, 16) said collar (31) rests against an axial ball bearing (37) as the opposite end limitation of the cylinder chamber (33).

14. Apparatus according to claim 13, characterized in that releaseable clamping elements for fixing a reel (11) to the supporting journal (15, 16) are arranged on the periphery of the supporting journal (15, 16); said clamping elements comprising radially movable clamping jaws (41) which are arranged distributed along the periphery and which, in order to fix the reel (11), are extendable in the radial direction against the inner face of the latter.

15. Apparatus according to claim 14, characterized in that the clamping jaws (41) are actuable pneumatically by means of an axial channel (54) which extends in the piston rod centrally relative to the axis of the latter and which opens out in the region of the clamping jaws (41) by means of distributor ducts (55) on the inside of a sleeve (45) made of elastic material, the clamping jaws (41) resting against the outer face of the sleeve (45) expandable by means of compressed air.

16. Apparatus according to claim 15, characterized in that, for the purpose of subjecting the sleeve (45) to pressure, the axial channel (54) opens out at the free end of a piston extension (50) within a compressed-air chamber (51) of the housing (29), and compressed air for subjecting the sleeve (45) to pressure is feedable to the compressed-air chamber (51) via a separate line connection (53).

17. Apparatus according to claim 16, characterized in that an electromagnetic tension brake (57) for determining the tension in a sheet running off from the reel (11) is assigned to the supporting journal (15, 16), raid electromagnetic brake being arranged inside the housing (29) and consisting of an axially displaceable brake ring (59) movable electromagnetically up against a counterring (60).

18. Apparatus according to claim 1, further comprising a feed conveyor (18) for feeding the reels (11) to a transfer station (14); said feed conveyor (18) being arranged above the reel-changing device (12), and comprising a reel track which is movable downwards in the conveying direction and on which the reels are aligned in a vertical plane.

19. Apparatus according to claim 18, characterized in that, in the region of the transfer station (14), the reels (11) are supported laterally, on the side located opposite the conveying arm (13), by means of guide legs (20) of the feed conveyor (18) and bracing legs (26) of an upper guede (25) which rests against the side of the reel.

* * * * *